United States Patent [19]

Goto

[11] 4,030,082

[45] June 14, 1977

[54] APPARATUS FOR THE TREATMENT OF YARN THICKNESS VARIATION SIGNALS

[75] Inventor: Tsugio Goto, Nobeoka, Japan

[73] Assignee: Asahi Kasei Kogyo Kabushiki Kaisha, Osaka, Japan

[22] Filed: Nov. 5, 1974

[21] Appl. No.: 521,189

Related U.S. Application Data

[63] Continuation of Ser. No. 343,980, March 22, 1973, Pat. No. 3,885,232.

[30] Foreign Application Priority Data

Mar. 24, 1972 Japan ..... 47-29893

[52] U.S. Cl. ..... 340/173 R; 340/172.5; 235/151.3; 235/92 PD; 324/111; 73/160

[51] Int. Cl.[2] ..... G11C 11/24; G06H 3/05

[58] Field of Search ..... 445/1; 340/172.5, 173 R, 340/173 CA, 146.1; 324/111; 73/160; 235/92 PD, 92 QD, 92 ST, 151.1, 151.13, 151.3, 151.35

[56] References Cited

UNITED STATES PATENTS

| | | | |
|---|---|---|---|
| 3,303,698 | 2/1967 | Loepfe | 73/160 |
| 3,456,116 | 7/1969 | Gunn | 73/160 X |
| 3,461,457 | 8/1969 | Kawamura et al. | 179/100.2 |
| 3,477,021 | 11/1969 | Dosch et al. | 73/160 X |
| 3,551,981 | 5/1970 | Jernigan et al. | 73/160 |
| 3,582,621 | 6/1971 | Lawler | 235/151.1 |
| 3,584,294 | 6/1971 | Siwko | 324/111 |
| 3,611,311 | 10/1971 | Andrews | 340/172.5 |
| 3,639,738 | 2/1972 | Laukien | 235/151.35 |
| 3,648,026 | 3/1972 | Abe et al. | 235/92 PD |
| 3,660,972 | 5/1972 | Neill et al. | 57/34 R |
| 3,680,299 | 8/1972 | Lee | 57/34 R |
| 3,689,898 | 9/1972 | Stites | 340/172.5 |
| 3,704,362 | 11/1972 | Kolby et al. | 235/151.13 |
| 3,705,391 | 12/1972 | Baker | 340/173 CA |
| 3,714,623 | 1/1973 | Mickler | 340/173 CA X |
| 3,727,033 | 4/1973 | Bassist | 235/92 PD |
| 3,731,069 | 5/1973 | Goto et al. | 235/151.3 |
| 3,790,887 | 2/1974 | Rich | 324/111 |
| 3,795,906 | 3/1974 | Erbstein | 73/160 X |
| 3,798,624 | 3/1974 | Baxter et al. | 340/213 R |
| 3,885,232 | 5/1975 | Goto | 340/173 R |

*Primary Examiner*—Gareth D. Shaw
*Assistant Examiner*—Jan E. Rhoads
*Attorney, Agent, or Firm*—Armstrong, Nikaido & Marmelstein

[57] ABSTRACT

This invention relates to a method and apparatus for processing yarn defect signals of a plurality of yarns on the on-line base.

For this purpose and in the case of the signal processing apparatus according to this invention a large number of yarn defect signals are processed through a scanning device for signal sampling, means is provided for placing possible drop-out signals into respective provisional memories, and preferably in the form of a binary "1" from a binary "0" and for reading out the contents from the memories at the beginning the next succeeding sampling period and for further processing these read-out yarn defects signals, together with regular yarn defects signals under processing through regular samplings.

1 Claim, 3 Drawing Figures

APPARATUS FOR THE TREATMENT OF YARN THICKNESS VARIATION SIGNALS

This is a continuation of application Ser. No. 343,980, filed March 22, 1973 now U.S. Pat. No. 3,885,232.

BACKGROUND OF THE INVENTION

This invention relates to a method and apparatus for processing yarn defects signals of a plurality of yarns on the on-line base for the overall evaluation of the yarn quality, said yarn defects signals being in the form of yarn thickness variation signals sensed through respective capacitor type sensors provided in a one-to-one relationship with said yarns.

Although the measurement of yarn defects signals of the above kind is a conventional technique, it has attracted the attention of those skilled in the art on account of its anticipating nature on later developable color strips and dyed specks which occur on a woven or knitted fabric made from the yarns upon later dyeing, weaving and the like processing.

These yarn defects information signals delivered from a large number of the capacitance type sensors are passed through and processed by a conventional electronic scanner for conveying these signals in succession from yarn to yarn into a common information processing apparatus, preferably an electronic computor, for evaluation of the general quality of the yarns under manufacture in a spinning plant.

In such yarn information processing and evaluation system, signals drop-outs may occur at interscanning periods and result in a fatal and adverse effect upon the generalized yarn quality determination being carried out for the yarn manufacturing plant.

SUMMARY OF THE INVENTION

It is therefore the main object of the invention to provide a unique, effective and substantially improved technique for avoiding interscanning signal drop-outs which have an important effect upon the general evaluation of yarn quality of a large number of synthetic yarns under manufacture.

For this purpose and in the care of processing a large number of yarn defects signals through scanning for signal sampling, means or step are provided for placing otherwise possible drop-out signals into a provisional memory, preferably in the form of a binary 1 from a binary 0 and for reading out these memorial contents from the memory at the beginning of the next succeeding sampling period and for further processing these read-out yarn defects signals, together with regular yarn defects under processing through regular samplings.

BRIEF DESCRIPTION OF THE DRAWINGS

These and further objects, features and advantages of the invention will become more apparent from the following detailed description of the invention by reference to the accompanying drawings, in which.

DESCRIPTION OF THE PREFERRED EMBODIMENT

In the following, the invention will be described more in detail by reference to the accompanying drawings illustrative of a preferred sole embodiment of the invention.

Figure 1:
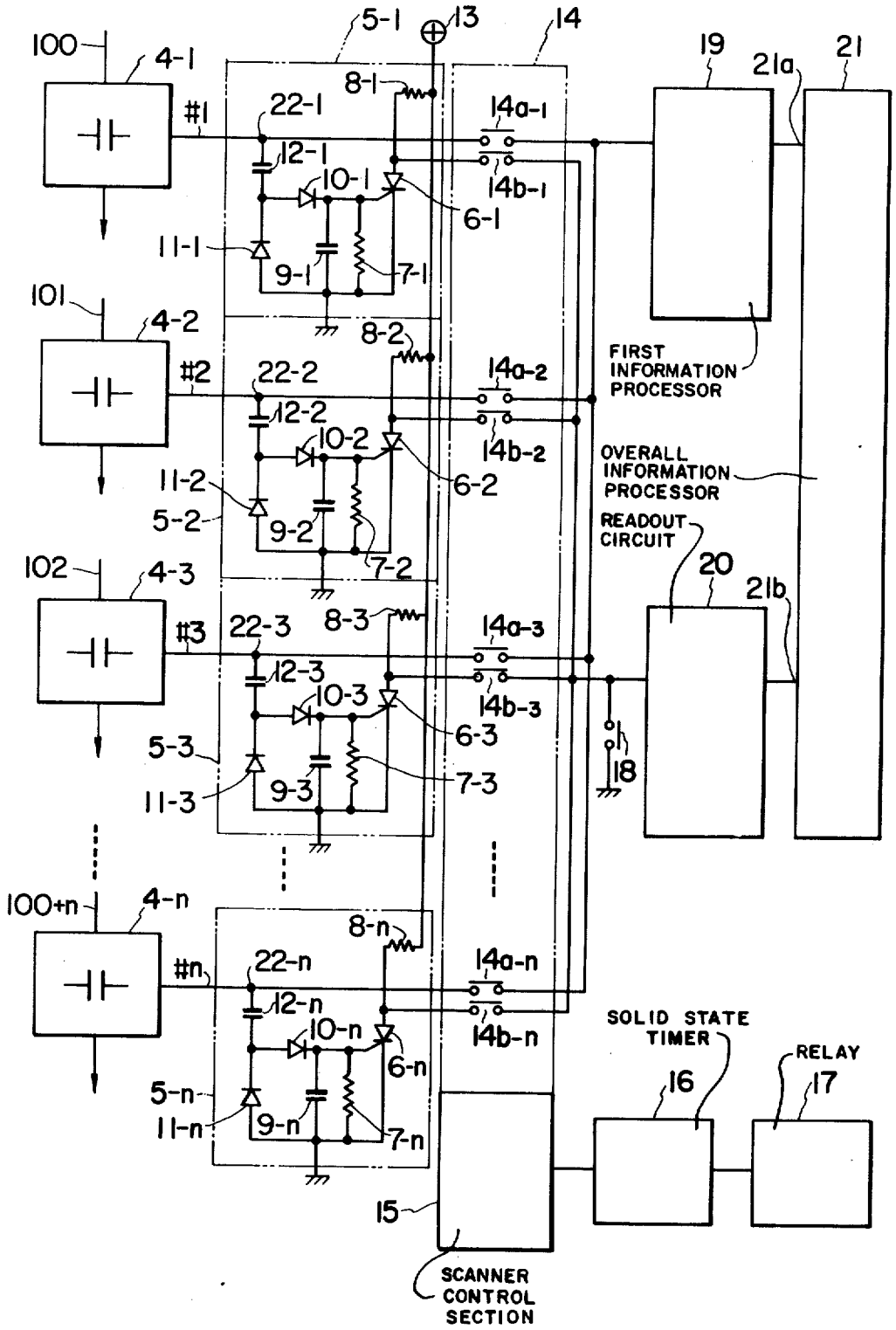
FIG. 1 is a schematic diagram parts of yarn defects signal processor adapted for carrying out the method according of this invention.

In FIG. 1, numeral 100 representing a yarn supplied from a spinning unit in its broadest sense, comprising at least, a spinneret, a stretcher and a scouring and the like after-treating unit, not shown. The yarn 100 is passed through a sensing gap formed between a pair of stationary condenser electrodes contained in a yarn defects sensor 4-1 of the capacitance type, shown only schematically in a block. The thus sensed yarn defects signal is supplied through an output lead No. 1 to input terminal 22-1 of a temporary memory circuit 5-1 which includes a silicon-controlled rectifier element 6-1 acing as memory element, condensers 9-1; 12-1 and semiconductor diodes 10-1; 11-1, resistors 7-1; 8-1, these circuit elements being electrically connected with each other as shown.

In the similar way, yarns 101; 102 .....100 + n are passed through respective yarn defects sensor 4-2; 4-3 ..... 4-n, each of which has similar structure as the first mentioned sensor 4-1, and the capacitively sensed yarn defects signals are fed therefrom through respective output leads No. 2; No. 3 ..... n to temporary memories 5-2; 5-3 ..... 5-n, respectively, each of which has similar structure as the first mentioned memory circuit 5-1.

Input terminals 22-2; 22-3 ..... 22-n correspond to that shown at 22-1. Silicon-controlled rectifier elements 6-2; 6-3 ..... 6-n are same with that shown at 6-1. Resistors 7-2; 7-3 ..... 7-n and 8-2; 8-3 ..... 8-n correspond to those 7-1 and 8-1, respectively. Condensers 9-2; 9-3 ..... 9-n and 12-2; 12-3 ..... 12-n correspond to those denoted 9-1 and 12-1, respectively. Semiconductor diodes 10-2; 10-3 ..... 10-n and 11-2; 11-3 ..... 11-n correspond to those denoted 10-1 and 11-1, respectively.

The respective yarn defects signals delivered from the sensors 4-1, 4-2, 4-3 ..... 4-n are shown in FIG. 1 at 1b, 2b, 3b ..... nb, representatively and by way of example. These yarn defects signals 1b, 2b, 3b, ..... nb are conveyed through scanning contacts 14a-1. 14a-2, 14a-3 ..... 14a-n of scanners 14; 15 to a first information processor 19, shown only schematically by a block, as its successive inputs.

On the other hand, the memoried signals in the temporary memories 5-1, 5-2, 5-3 ..... 5-n, as being shown representatively and only by way of example at 3c and nc in FIG. 1, are taken out and conveyed through respective scanning contacts 14b-1, 14b-2, 14b-3 ..... 14b-n of scanners 14; 15 to a read-out circuit 20 in succession, said circuit 20 being shown only schematically by a block. The operational sequence of the said first and second scanning contact series may be in the order of 14a-1; 14b-1; 14a-2; 14b-2; 14a-3, 14b-3 ..... 14a-n; 14b-n.

Numeral 21 represents a final and overall information processor shown only schematically by a block and connected at its respective inputs 21a and 21b with the first and second information processor 19 and 20, and adapted for processing the signal outputs therefrom. When a full-automatic signal processing system is to be realized, the final processor 21 may be a digital type electronic computer. Or alternatively, when a rather simplified information record system is to be realized, the final information processor 21 may be a digital printer or terminal recorder.

The part denoted 15 of the scanning circuit 14; is a control section thereof and is connected in series with a solid state timer 16 and a relay 17 which are shown only schematically by respective blocks. In synchronism with the scanning operations shown at 1a1; 2a1 and 3a1 in FIG. 2 or 3, the control section 15 delivers successively signals 22a of the signal series 22 to timer 16 which, when thus energized, initiates its operation for a predetermined time period when one of signal 23a belonging to signal series comes. At this time, relay 17 energized so as to close its contact 18 connected between the input to of the processor 20 and ground. Timer 16 is reset when the signal 22b arrives in the signal series 22, thereby the operation of relay 17 is terminated so as to release its relay contact 18 from its closed position. The contact 18 is thus opened again.

Figure 2:
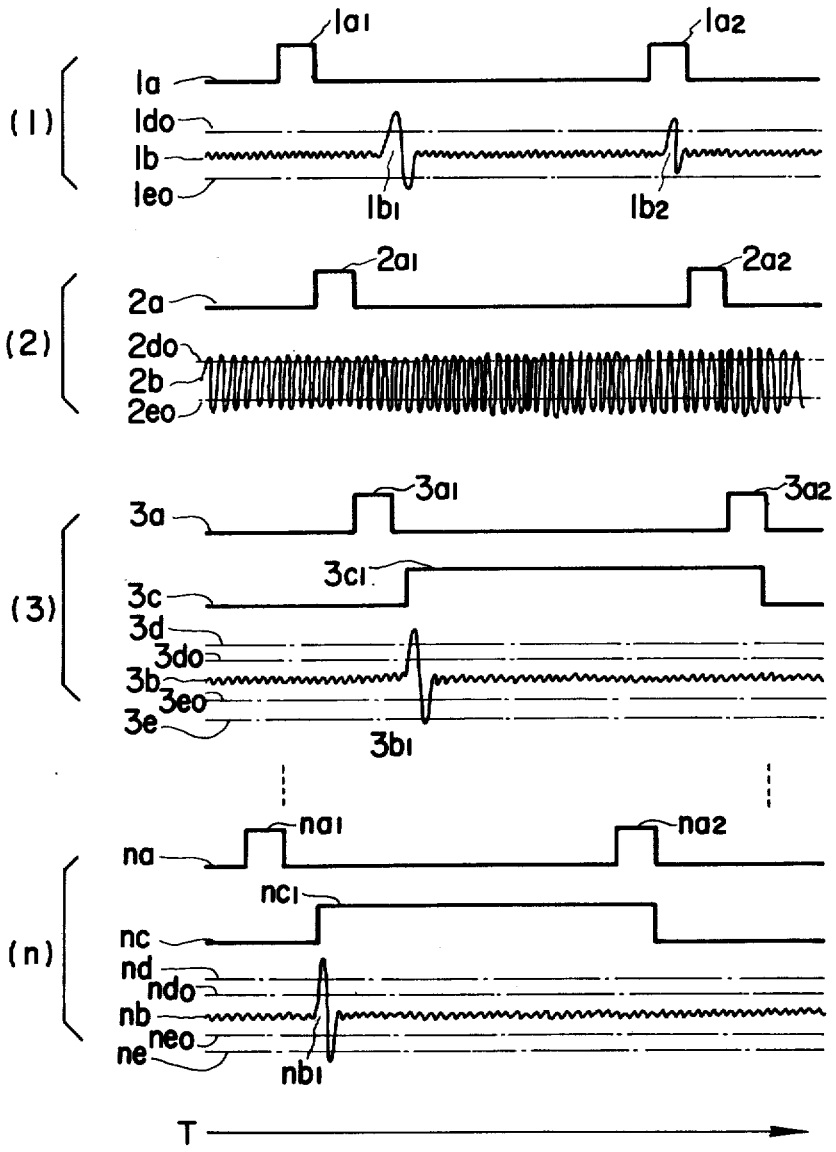
FIG. 2 is a chart for illustration of the operating modes of the signal processing system for n-yarns.

In FIG. 2, (1) represents a group of signal series representing in turn those necessary for the operation of the first sensor 4-1 and its following electronic parts. In the similar way, (2) represents a similar group of signals series representing in turn those necessary for operation of the second sensor 4-2 and its following electronic parts. Similarly, (3) ..... (n) are related to sensors 4-3 ..... 4-n and their following electronic parts. Arrows T appearing in FIGS. 2 and 3 demonstrate the progress of time.

Wave series 1a; 2a; 3a ..... na represents respective signal sampling modes. The operational sequence can be more clearly understood by reference to FIG. 3.

As an example, the sampling is carried out for each of the time periods of 1a1; 1a2 ..... in connection with the first yarn defects signal 1b.

Similarly, for each of the time periods of 2a1, 2a2 ....., sampling is carried out in connection with the second yarn defects signal 2b.

Samplings are carried out in the similar way at each of time periods 3a1; 3a2 ..... of the wave series 3a in connection with the yarn defects signal 3b.

In the case of n-th yarn defects signal series nb, sampling will be carried out at each of the time periods na1; na2 ..... of the wave series na.

In the case of the first yarn defects signal series 1b, the second irregular signal pulse 1b-2 is developed during the sampling period 1a2 and exceed the upper established level 1d0 of both limiting levels 1d0; 1eO, thus it is treated as a yarn defect in the information processing.

Further, in the case of the second yarn defects signal series 2b, all the pulses exceeding established levels 2d0; 2e0 are thus subjecting to information processing at each of the sampling periods 2a1; 2a2.

Next, consider the first year defect signal 1b1 appearing in the first signal series 1b which developed outside of the regular and related sampling periods. Accordng to the conventional sampling method, this yarn defect pulse would not be taken into account, thus representing a fatal drawback in the conventional technique.

This drawback can be remedied according to the present invention.

As an example, the yarn defect pulse 3b1 appearing in the third yarn defects signal series 3b exceeds the established level 3d; 3e and thus, the temporary memory circuit 5-3 is energized upon reception of this yarn defect pulse. Thus the energized memory state thereof is continued until the next sampling time period 3a2 arrives and terminates, as shown at 3c1 in the wave series 3a. At the arrival of the sampling period 3a2, the memorized information is read out as a yarn defect signal which will be processed. Upon this read-out, the memory is reset and cleared for the next memorial operation.

The same will be applied to the yarn defect pulse nb1 appearing in the n-th yarn defects signal series nb and, outside of the two successive sampling periods na1 and na2 of wave series na and exceeding the both established limiting levels nd; ne. The memorized signal is shown at nc1 of the signal series nc. The pulse nb1 represents, in this case also, a random and large yarn defect such as a defective broken monofilament ball in a multifilament.

As an example, an on-line yarn quality control system in a multifilament yarn manufacturing factory will be explained with reference to FIGS. 2 and 3.

In this case, the sensors 4-1, 4-2, 4-3 .....4-n are attached one by one to all the stretching twister units contained in the factory, and each being provided directly upstream of the related pirn winding stage. Thus, all the manufacturing multifilaments are sensed and the sensed yarn strength variation information signals are fed out from the respective sensors to conveying leads No. 1, No. 2, No. 3 .....No. n, as was explained hereinbefore. These signals are subjected to sampling once every ten seconds per yarn, through the on-off operation of relay contacts 14a-1; 14a-2; 14a-3 ..... 14a-n. These successively sampled signals are conveyed to the first primary processor 19, as was referred to hereinbefore.

As an example and as was referred hereinbefore, a random and larger yarn defect pulse 3b1, representing mostly a pill, appearing outside of sampling periods such as 3a1 and 3a2 and exceeding the limiting levels 3d and 3e, will be conveyed from lead No. 3 and through input terminal 22-3; condenser 12-3; semiconductor diodes 10-3; 11-3, condenser 9-3 and resistor 7-3 to the control grid of silicon-controlled rectifier element 6-3 which is thus energized. With energization of the element 6-3, the potential at the anode side of the element 6-3 which continue to operate even if the large yarn defect signal decreases to those lying within its regular and allowable range defined by and between the limiting both levels. This means that by the presence of the random and large yarn defect signal representing a pill or the like has been transformed from binary 0 to binary 1 by actuation of the element 6, as expressed at nc1 in FIG. 2 for memory purpose. This memory condition will continue until the next succeeding sampling period 3a2 comes, as was referred to hereinbefore. At this last-mentioned period, both sampling contacts 14a-3 and 14b-3 are closed simultaneously, the large yarn defect signal 3b1 will thus be conveyed through the now-closed first relay contact 14a-3 to first primary processor 19 and the read-out binary signal 1 from the memory 5-3 through the anode of silicon-controlled element 6-3 and the now closed relay second contact 14b-3 to second primary processor 20 acting as large yarn defect read-out circuit which is thus brought into actuation.

The outputs from the both primary processor 19 and 20 are conveyed to final and overall processor 21 which may preferably a digital type electronic computer as was referred to hereinbefore.

The first primary processor 19 may treat simultaneously those yarn defect signals which represent the mean wave height characteristics of the yarn defect signals displaying in advance color strips to appear in the dyed and woven fabric; the mean wave area characteristics of the yarn defect signals indicating in advance dyed specks to appear later; the degree or sizes of the developed monofilament pills; the developed extraordinary monofilament conditions and yarn breakage information, if any.

Outputs from the final processor 21 may be used primarily for providing an indication of the overall yarn quality of the products from the factory. The processed overall yarn information can be utilized for control of the quality of the spinning material and/or the overall spinning conditions of the factory plant.

Figure 3:
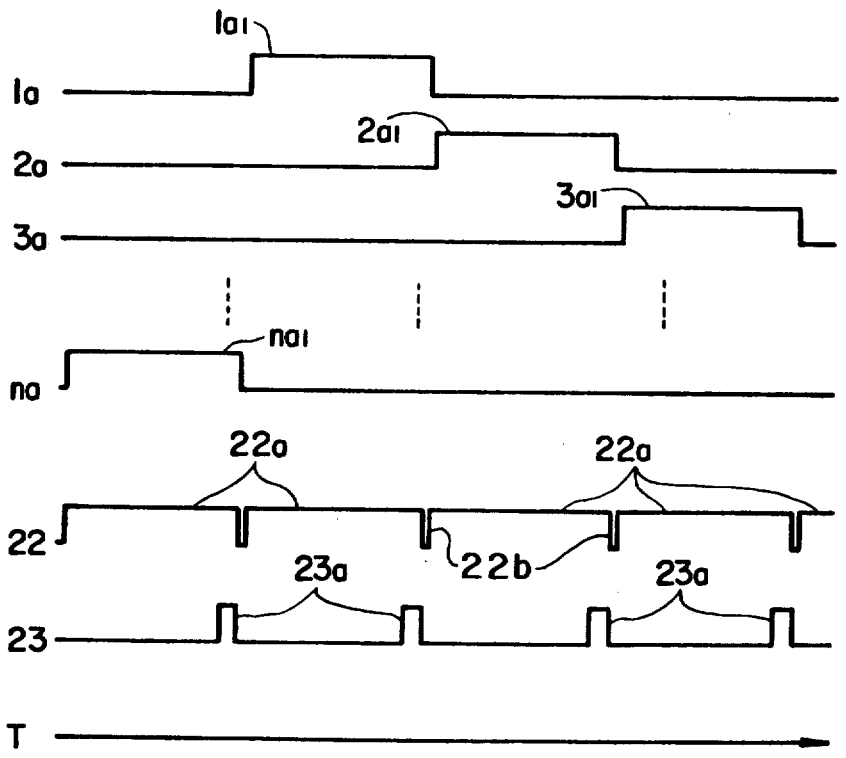
FIG. 3 is an additional chart to FIG. 2 adopted for the same illustrating purpose.

At each of the short time durations 23a of wave series 23, in FIG. 3, extending 1 second, as an example, the relay contact 18, in FIG. 1, is closed and the anode of the now operating silicon-controlled element 6-3 is grounded through the closed relay contacts 14b-3 and said contact 18. Therefore, the element 6-3 is reset for sensing and preserving again the large yarn defect signal.

In the preferred embodiment shown and described, the scanning apparatus has a signal sampling period of 10 seconds per one spinning unit, not shown, from which one of the multifilament yarn 100; 101; 102 ..... or 100 + n is delivered. The yarn stretching and winding plant in the factory is assumed to have 156 such spinning units. Therefore, in this case, the sampling period will be 26 minutes. In other words, the sampling for one spinning unit is carried out for 10 seconds per 26 minutes. These data have been selected mainly and naturally from economical reasons.

In practice, a continuous defect signal as shown at 2b in FIG. 2 may be frequently encountered during manufacture of synthetic multifilaments with which the invention is concerned. In this case, also, the aforementioned kind of the sampling mode is sufficiently for the desired purpose. On the other hand, even if a large yarn defect as shown at 1b1; 1b2; 3b1 or nb1 should not be sensed, the resulted pirn could be discarded exclusively from this reason. According to the present invention, such large yarn defects as large filament pills can be practically continuously sensed and processed with an economical sampling system as shown and described. Thus, it is highly valuable for the purpose of on-line supervision of a large number of multifilament yarns as spun, stretched and wound, thereby providing a remarkable progress in the art.

As referred to, the randomly developed large yarn defects are stored in the provisional memory wherein in each reception of the corresponding yarn defects signals the binary 0 is changed in its state into the binary 1, thus the memory means is simple and inexpensive. The read-out operation for taking out the memorized yarn defects signal from the memory can be made simple and inexpensive in comparison with comparative conventional means.

In FIG. 2 at (3), different effective signal ranges 3d0; 3e0 and 3d; 3e are shown in an overlapped manner for showing possible alteration of the range depending upon the kind and nature of the yarn and the scope and purpose of the yarn quality evaluation. In FIG. 2 at (n), the same is applied to the different and overlapped effective yarn signal ranges defined by nd0; ne0 and nd; ne, respectively.

The embodiments of the Invention in which an exclusive property or privilege is claimed are as follows:

1. An apparatus for processing defect signals from a plurality of yarns wherein said signals may be applied to a computer, said apparatus comprising:

a. a plurality of sensor means, each sensor means associated with one of said yarns for detecting a defect in said yarns;

b. a plurality of memory means, each of said memory means coupled to a corresponding one of said sensor means for storing a defect signal produced by the corresponding said sensor means;

c. scanner means coupled to said plurality of memory means and to said computer for cyclically sequentially sampling the signals stored in said memory means and applying the signals stored therein to said computer; and d. reset means for periodically resetting said memory means at the beginning of each sampling cycle.

* * * * *

Disclaimer 4,030,082.—*Tsugio Goto*, Nobeoko, Japan. APPARATUS FOR THE TREATMENT OF YARN THICKNESS VARIATION SIGNALS. Patent dated June 14, 1977. Disclaimer filed Mar. 14, 1977, by the assignee, *Asahi Kasei Kogyo Kabushiki Kaisha.*

The term of this patent subsequent to May 20, 1992, has been disclaimed. [*Official Gazette July 26, 1977.*]